US005457010A

United States Patent [19]

Satake et al.

[11] Patent Number: 5,457,010

[45] Date of Patent: * Oct. 10, 1995

[54] SOLID PROCESSING COMPOSITION FOR SILVER HALIDE PHOTOGRAPHIC LIGHT-SENSITIVE MATERIALS

[75] Inventors: Wataru Satake; Yoshimasa Komatsu, both of Hino, Japan

[73] Assignee: Konica Corporation, Japan

[ * ] Notice: The portion of the term of this patent subsequent to Aug. 9, 2011 has been disclaimed.

[21] Appl. No.: 276,343

[22] Filed: Jul. 18, 1994

[30] Foreign Application Priority Data

Jul. 28, 1993 [JP] Japan ..... 5-186259

[51] Int. Cl.[6] ..... G03C 7/413

[52] U.S. Cl. ..... 430/465; 430/486; 430/489; 430/490

[58] Field of Search ..... 430/465, 484, 430/485, 486, 489, 490, 493

[56] References Cited

U.S. PATENT DOCUMENTS 3,981,732 9/1976 Emoto et al. ..... 430/465
5,336,588 8/1994 Ueda ..... 430/465
5,362,610 11/1994 Yoshimoto ..... 430/465

FOREIGN PATENT DOCUMENTS 12329 1/1979 Japan ..... 430/465

*Primary Examiner*—Hoa Van Le
*Attorney, Agent, or Firm*—Jordan B. Bierman; Bierman and Muserlian

[57] ABSTRACT

A solid developing composition for providing a color developer of a silver halide photographic light-sensitive material is disclosed, which comprises a compound represented by the following Formula (I), and a compound represented by the following Formula (II) or a saccharide:

Formula (I)

Formula (II)

11 Claims, No Drawings

SOLID PROCESSING COMPOSITION FOR SILVER HALIDE PHOTOGRAPHIC LIGHT-SENSITIVE MATERIALS

FIELD OF THE INVENTION

The invention relates to a solid processing composition for a silver halide photographic light-sensitive material, and particularly to a solid processing composition for a silver halide photographic light-sensitive material having markedly improved storage stability, being free from precipitates on dissolving, and enabling uniform dispersion of the components and stable processing.

BACKGROUND OF THE INVENTION

A silver halide photographic light-sensitive material is photographically processed through a development step, a bleaching step, a washing step and a stabilization step after being exposed. The photographic processing is ordinarily conducted using an automatic processing machine. On such occasions, a replenisher replenishing system is commonly used wherein the processing solution in a processing tank is controlled so that the activity thereof is kept constant. In the case of the replenisher replenishing system, the purposes thereof include dilution of materials dissolved out from the light-sensitive material, correction of the amount of evaporation and replenishment of consumed components. Because of solution replenishing, much overflow-solution is ordinarily discharged.

Recently, world wide movements for regulations on prohibiting dumping photo-effluent into oceans and regulations against disposal of plastic materials have been promoted. Accordingly, development of a new system in which photographic waste solution is markedly reduced and bottles for processing agents are eliminated is demanded. In addition, safety regulations on packaging materials have been made strengthened to maintain safety regarding the transportation of liquid hazardous substances, resulting in an increase of cost. In mini-labs which have recently proliferated rapidly, errors frequently occur during dissolution or dilution operations of the replenishing solutions due to a lack of man power. Therefore, this conventional replenishment system has drawn much frequent complaints.

Accordinly, in the photographic industry a new replenishing system is demanded in which photographic waste solution is markedly reduced, bottles for processing agents are eliminated and dissolving operations are also eliminated.

In response to these demands WO92-20013 discloses a method of solidifying almost all processing components and directly supplying these solids in processing tanks. However, it has been proved that in this method a concentration degree of the components in a color developing solution markedly increases compared to the conventional liquid color developer, and the storage stability due to aging of the solution deteriorates. Particularly when tableted and molded, the components react with each other by pressure-caused heat and storage stability problems occur. Further, localized concentrations of the components increase on dissolving, resulting in precipitates, filter clogging and adhesion of the precipitates to the surface of the light-sensitive materials to be processed.

It is essential that in color developer containing various components in various amounts the components are contained in a specific amount therein. When the component content of the developer deviates, the process stability deteriorates, resulting in serious problems in photographic properties.

The color developer of photographic processing agents plays an important role in determining photographic properties, and the controlling method of the component is a proposition to be solved in the art. As for concentration latitude of the components, the fluctuation range of the main components such as a color developing agent or an alikali is not less than 10 weight %, and that of an auxiliary agent such as a fluorescent brightening agent is not less than 15 weight %. When the processing agent out of the above range is used, it results in extraordinary development, either too active or inactive.

It is easy to obtain a specific amount of a liquid processing agent, since uniform dispersion can be obtained by diluting it. As for the solid processing composition, mixing problems made it difficult to obtain a unifom dispersion. To overcome the above problem one can consider a method of weighing every component individually and mixing all components; however, this method is troublesome in production and not preferable in view of cost, control and speed regarding the equipment. These have been problems in producing the solid color developing composition.

Accordingly, it is a high priority to develop a technique to solve the above problems.

SUMMARY OF THE INVENTION

An object of the invention is to provide a solid processing composition which overcomes the above problems, does not lower the storage stability due to aging, does not produce precipitates or the like, and contains every component in a specific amount therein.

The above object of the invention can be attained by a solid processing composition comprising a compound represented by the following Formula (I) and at least one of a compound represented by the following Formula (II) and a saccharide:

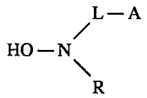

Formula (I)

wherein L represents an alkylene group; A represents a carboxy group, a sulfo group, a phosphono group, a phosphinic acid group, a hydroxy group, an amino group, an ammonio group, a carbamoyl group or a sulfamoyl group; and R represents a hydrogen atom or an alkyl group,

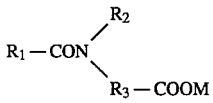

Formula (II)

wherein $R_1$ represents an alkyl group; $R_2$ represents a hydrogen atom or an alkyl group; $R_3$ represents an alkylene group; and M represents a hydrogen atom, a sodium atom, a potassium atom, lithium atom or a triethanolammonium group.

DETAILED DESCRIPTION OF THE INVENTION

The present inventors have carried out numerous experiments in solidifying a color developing composition and found a solid color developing composition which is stable and gives stable processability. The conventional solid processing composition containing hydroxylamine salts having been used so far increases moisture therein as it ages on account of its hygroscopicity and deliquescence. The alkali agent, a color developing agent and moisture of the solid processing composition reacts with each other comprising an oxidation reaction. As a result, tar occurs and the concentration of the effective components lowers, resulting in poor photographic properties. When the solid processing composition is prepared by compression-molding, the inside reaction is likely to proceed by heat since a pressure not less than several hundred kg/cm$^2$ is applied.

Particularly in the color developing composition it is necessary to keep the concentration of the effective components constant. The color developing composition usually is a mixture of not less than 5–6 kinds of components and it has been difficult to mix them as a solid and disperse them uniformly. In view of productivity, in order to prepare a specific amount of a color developing composition a method of preparing it from a definite amount of a mixture composition obtained by mixing individual component is by far more advantageous and more reasonable than that of preparing it by weighing the components one by one and mixing them.

The processing composition is worthless unless the components are uniformly mixed. These problems have been solved by a solid processing composition containing a specific hydroxylamine derivative compound represented by Formula (I) instead of hydroxylamine and a compound represented by Formula (II), and the present invention has been attained by it. The solid processing composition of the invention enables the main components such as main agents and an alkali agent to disperse effectively and uniformly.

The present invention will be detailed below. The solid processing composition of the invention may be in the form of powder, granules or tablets, and preferably in the form of granules or tablets in view of the reliability of its incorporation into the processing tank. The most preferable is in the form of tablets. The powder refers to an aggregation of fine particles, the granules ones having a particle diameter of 50 to 5000 μm obtained by granulating the powder, and tablets are obtained by compression-molding the powder or the granules into a specific form. The molding pressure is preferably 400–3000 kg/cm$^2$.

As for a method of solidifying the photographic processing composition, there can be used methods detailed in JP O.P.I. Publication Nos. 4-29136/1992, 4-85535/1992, 4-85536/1992, 4-85533/1992, 4-85534/1992 and 4-172341/1992.

A granulating method for forming granules or tablets includes, for example, any well-known method such as a convoluting granulation method, an extruding granulation method, a compressing granulation method, and a fluidized-bedding granulation method. It is preferable in view of the reliability of the granule incorporation that not less than 60% of the whole resulting granules have a granule-size distribution within the deviation range of ±100 to 150 μm.

A tablet type processing composition can be prepared in any of well known processes or the method detailed in JP OPI Publication Nos. 51-61837/1976, 54-155038/1979 and 52-88025/1977 and British Patent No. 1,213,808. Also, the preparation of the granulated processing composition is detailed in JP OPI Publication Nos. 2-109042/1990, 2-109043/1990, 3-39735/1991 and 3-39739/1991. Further, a powder type processing composition can be prepared in any of well known processes as detailed in JP OPI Publication No. 54-133332/1979, British Patent Nos. 725,892 and 729,862 and German Patent No. 3,733,861.

Now, the compounds used in the invention represented by Formula (I) will be detailed.

In the formula, L represents a straight-chained or branched alkylene group having 1 to 10 carbon atoms which may have a substituent and, among them, those having 1 to 5 carbon atoms are preferred. To be more concrete, the preferable examples thereof include a methylene group, an ethylene group, a trimethylene group and a propylene group. As for the substituents thereof include, for example, a carboxy group, a sulfo group, a phosphono group, a phosphinic acid residual group, a hydroxy group, an ammonio group which may have an alkyl group and, among them, the preferable examples thereof include a carboxy group, a sulfo group, a phosphono group and a hydroxy group; A represents a carboxy group, a sulfo group, a phosphono group, a phosphinic acid residual group, a hydroxy group, an amino group which may have an alkyl group, an ammonio group which may have an alkyl group, a carbamoyl group which may have an alkyl group or a sulfamoyl group which may have an alkyl group and, among them, the preferable examples thereof include a carboxy group, a sulfo group, a hydroxy group, a phosphono group and a carbamoyl group which may have an alkyl group. The examples of —L—A include, preferably, a carboxymethyl group, a carboxyethyl group, a carboxypropyl group, a sulfoethyl group, a sulfopropyl group, a sulfobutyl group, a phosphonomethyl group, a phosphonoethyl group and a hydroxyethyl group and, among them, the particularly preferable examples thereof include a carboxymethyl group, a carboxyethyl group, a sulfoethyl group, a sulfopropyl group, a phosphonomethyl group and a phosphonoethyl group; and R represents a hydrogen atom, a straight-chained or branched alkyl group having 1 to 10 carbon atoms which may have a substituent and, among them, those having 1 to 5 carbon atoms are preferred. The substituents thereof include, for example, a carboxy group, a sulfo group, a phosphono group, a sulfinic acid residual group, a hydroxy group, an amino group which may have an alkyl group, an ammonio group which may have an alkyl group, a carbamoyl group which may have an alkyl group, a sulfamoyl group which may have an alkyl group, provided that there may be two or more substituents. The preferable examples thereof represented by R include a hydrogen atom, a carboxymethyl group, a carboxyethyl group, a carboxypropyl group, a sulfoethyl group, a sulfopropyl group, a sulfobutyl group, a phosphonomethyl group, a phosphonoethyl group and a hydroxyethyl group and, among them, the particularly preferable examples thereof include a hydrogen atom, a carboxymethyl group, a carboxyethyl group, a sulfoethyl group, a sulfopropyl group, a phosphonomethyl group and a phosphonoethyl group, provided that L and R may also be coupled to each other so as to form a ring.

Next, among the compounds represented by Formula (I), some typical examples thereof will be given below. However, the invention shall not be limited to the compounds given below.

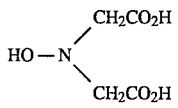

(1)

-continued
(2)
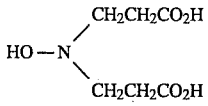
(3)
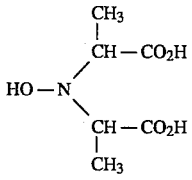
(4)
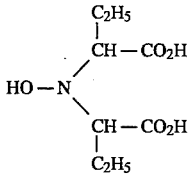
(5)
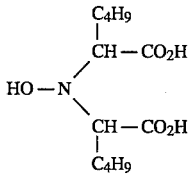
(6)
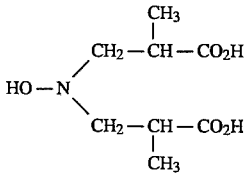
(7)
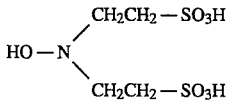
(8)
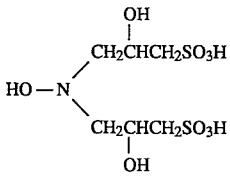
(9)
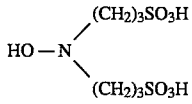
(10)
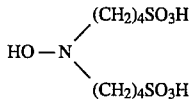
(11)
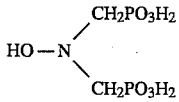
-continued
(12)
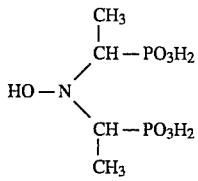
(13)
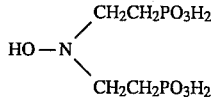
(14)
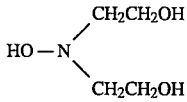
(15)
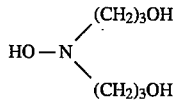
(16)
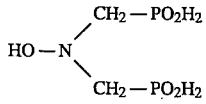
(17)
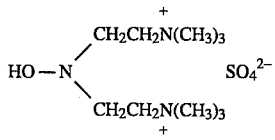
(18)
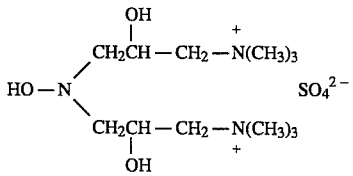
(19) $HO-NH-CH_2CO_2H$
(20) $HO-NH-CH_2CH_2CO_2H$
(21)
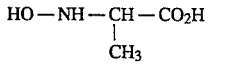
(22)
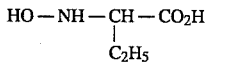
(23)
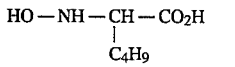
(24)
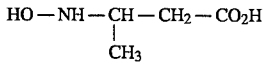
(25)
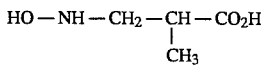
(26) $HO-NH-CH_2CH_2SO_3H$
(27)
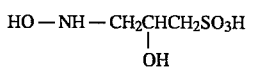
(28) $HO-NH-(CH_2)_3SO_3H$
(29) $HO-NH-(CH_2)_4SO_3H$ -continued $HO-NH-CH_2PO_3H_2$ (30)

$HO-NH-CH(CH_3)-PO_3H_2$ (31)

$HO-NH-CH_2CH_2PO_3H_2$ (32)

$HO-NH-CH_2CH_2OH$ (33)

$HO-NH-(CH_3)_3OH$ (34)

$HO-NH-CH_2-PO_3H_2$ (35)

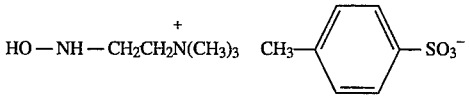
(36)

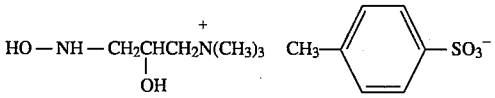
(37)

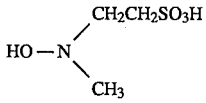
(38)

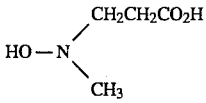
(39)

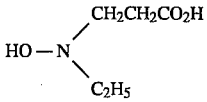
(40)

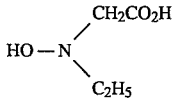
(41)

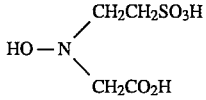
(42)

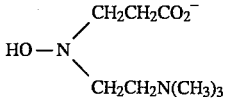
(43)

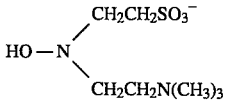
(44)

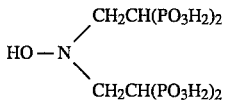
(45)

$HONHCH_2CH(PO_3H_2)_2$ (46)

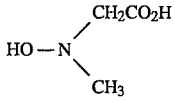
(47)

-continued

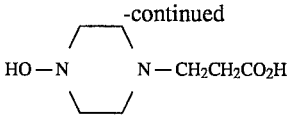
(48)

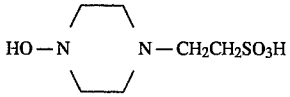
(49)

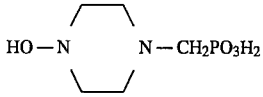
(50)

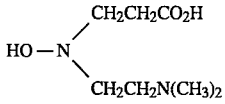
(51)

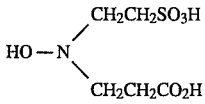
(52)

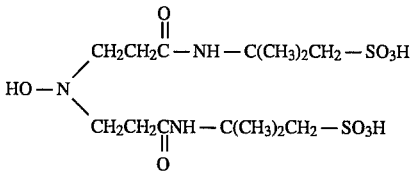
(53)

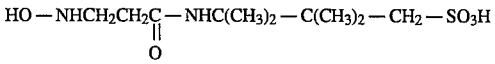
(54)

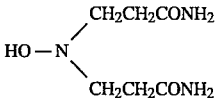
(55)

The content of these compounds in the solid developing composition is 0.3 to 25% by weight, and preferably 0.6 to 18% by weight.

The compounds represented by Formula (I) can be synthesized by making an alkylating reaction (such as a nucleophilic substituting reaction, an adduct reaction and a Mannich reaction) with a hydroxylamine readily available on the market. The synthesization thereof can be performed with reference to the synthesization procedures described in West German Patent Publication "Inorganica Chimica Acta", 93, (1984), pp. 101–107, and so forth.

The saccharides in the invention refer to monosaccharides or polysaccharides in which monosaccharides bind through a glycosid bondage or decomposition compounds thereof.

Monosaccharides refer to a polyhydroxy aldehyde, polyhydroxy ketone or their derivatives such as reduced derivatives, oxidized derivatives, deoxy derivatives, amino derivatives or thio derivatives. Most of them are represented by the general formula $C_nH_{2n}O_n$. The monosaccharides in the invention include derivatives derived from saccharide skelton represented by the above formula. The preferable are sugar alcohols having a primary or secondary alcohol group to which an aldehyde or ketone group is reduced.

Polysaccharides include celluloses, starches or glycogens. The celluloses include derivatives such as cellulose ethers in which all or a part of hydroxy group are etherified, starches include maltose or dextrins that starches are hydrolyzed to various decomposition compounds. Celluloses may be in an alkali salt form in view of solubility. Among polysaccharides, celluloses or dextrins are preferably used, and dextrins are more preferably used.

Examples of monosaccharides in the invention will be shown below.

Exemplified compounds

| | |
|---|---|
| B-(1) | glycelaldehyde |
| B-(2) | dihydroxyacetone (including a dimer) |
| B-(3) | D-erythrulose |
| B-(4) | L-erythrulose |
| B-(5) | D-threose |
| B-(6) | L-threose |
| B-(7) | D-ribose |
| B-(8) | L-ribose |
| B-(9) | D-arabinose |
| B-(10) | L-arabinose |
| B-(11) | D-xylose |
| B-(12) | L-xylose |
| B-(13) | D-lixose |
| B-(14) | L-lixose |
| B-(15) | D-xylulose |
| B-(16) | L-xylulose |
| B-(17) | D-ribulose |
| B-(18) | L-ribulose |
| B-(19) | 2-deoxy-D-ribose |
| B-(20) | D-allose |
| B-(21) | L-allose |
| B-(22) | D-altrose |
| B-(23) | L-altrose |
| B-(24) | D-glucose |
| B-(25) | L-glucose |
| B-(26) | D-mannose |
| B-(27) | L-mannose |
| B-(28) | D-gulose |
| B-(29) | L-gulose |
| B-(30) | D-idose |
| B-(31) | L-idose |
| B-(32) | D-galactose |
| B-(33) | L-galactose |
| B-(34) | D-talose |
| B-(35) | L-talose |
| B-(36) | D-quinobose |
| B-(37) | digitalose |
| B-(38) | Digitoxose |
| B-(39) | Cymalose |
| B-(40) | D-sorbose |
| B-(41) | L-sorbose |
| B-(42) | D-Tagatose |
| B-(43) | D-fucose |
| B-(44) | L-fucose |
| B-(45) | 2-deoxy-D-glucose |
| B-(46) | D-psicose |
| B-(47) | D-fructose |
| B-(48) | L-fructose |
| B-(49) | D-rhamnose |
| B-(50) | D-galactosamine |
| B-(51) | L-galactosamine |
| B-(52) | D-mannosamine |
| B-(53) | D-glycero-D-galactoheptose |
| B-(54) | D-glycero-D-mannoheptose |
| B-(55) | D-glycero-L-mannoheptose |
| B-(56) | D-glycero-D-guloheptose |
| B-(57) | D-glycero-D-idoheptose |
| B-(58) | D-glycero-L-glucoheptose |
| B-(59) | D-glycero-L-taloheptose |
| B-(60) | D-altroheptulose |
| B-(61) | D-mannoheptulose |
| B-(62) | D-altro-3-heptulose |
| B-(63) | D-glucuronic acid |
| B-(64) | L-glucuronic acid |
| B-(65) | N-acetyl-D-glucosamine |
| B-(66) | Glycerin |
| B-(67) | D-threitol |
| B-(68) | L-threitol |

-continued

| | |
|---|---|
| B-(69) | Erithorit (produced by Mitsubishi Kasei Shokuhin Co. Ltd., Erythritol) |
| B-(70) | D-arabitol |
| B-(71) | L-arabitol |
| B-(72) | adnite |
| B-(73) | xylitol |
| B-(74) | D-sorbitol |
| B-(75) | L-sorbitol |
| B-(76) | D-mannitol |
| B-(77) | L-mannitol |
| B-(78) | D-iditol |
| B-(79) | L-iditol |
| B-(80) | D-talitol |
| B-(81) | L-talitol |
| B-(82) | dulcin |
| B-(83) | allodulcitol |

Of these compounds, B-(66) through (83) are preferably used, and B-(69) and B-(74) through (83) are more preferably used.

Examples of polysaccharides and their decomposition compounds in the invention will be shown below.

| | |
|---|---|
| C-(1) | Maltose |
| C-(2) | Cellobiose |
| C-(3) | trehalose |
| C-(4) | gentiobiose |
| C-(5) | isomaltose |
| C-(6) | lactose |
| C-(7) | raffinose |
| C-(8) | gentianose |
| C-(9) | stachyose |
| C-(10) | xylan |
| C-(11) | araban |
| C-(12) | Glycogen |
| C-(13) | dextran |
| C-(14) | inulin |
| C-(15) | levan |
| C-(16) | galactan |
| C-(17) | agalose |
| C-(18) | amylose |
| C-(19) | sucrose |
| C-(20) | agarobiose |
| C-(21) | Methylcellulose |
| C-(22) | Dimethylcellulose |
| C-(23) | Trimethylcellulose |
| C-(24) | Ethylcellulose |
| C-(25) | Diethylcellulose |
| C-(26) | Triethylcellulose |
| C-(27) | Carboxymethylcellulose |
| C-(28) | Carboxyethylcellulose |
| C-(29) | Aminoethylcellulose |
| C-(30) | Hydroxymethylcellulose |
| C-(31) | Hydroxyethylcellulose |
| C-(32) | Hydroxypropylcellulose |
| C-(33) | Hydroxypropylmethylcellulose |
| C-(34) | Hydroxypropylmethylcelluloseacetatesuccinate |
| C-(35) | carboxymethylhydroxyethylcellulose |
| C-(36) | α-dextrin |
| C-(37) | β-dextrin |
| C-(38) | γ-dextrin |
| C-(39) | δ-dextrin |
| C-(40) | ε-dextrin |
| C-(41) | α-limit-dextrin |
| C-(42) | β-limit-dextrin |
| C-(43) | Phospherylase limit dextrim |
| C-(44) | Soluble starch |
| C-(45) | Thin-boling starch |
| C-(46) | White dextrin |
| C-(47) | Yellow dextrin |
| C-(48) | British gumm |
| C-(49) | α-cyclodextrin |
| C-(50) | β-cyclodextrin |
| C-(51) | γ-cyclodextrin |

-continued

| | |
|---|---|
| C-(52) | Hydroxypropyl-α-cyclodextrin |
| C-(53) | Hydroxypropyl-β-cyclodextrin |
| C-(54) | Hydroxypropyl-γ-cyclodextrin |
| C-(55) | Maltodextrin |

Of these compounds, C-(36) through (55) are preferably used, and C-(49), (50), (52), (53) and (55) are more preferably used. The weight average molecular weight of dextrins used in the invention may be any, but it is preferably 100 through 10000.

Saccharides exist widely in the nature, and are available on the market. The derivatives can be readily prepared by reduction, oxidation or dehydration reactions. The starch decomposition compounds available on the market include Pineflow, Pine-dex series, Food-tex, Max 100, Glistar P, TK-56, MPD, H-PDX and Stuco-dex produced by Matstani Kagaku Co., Ltd. or Oil Q series produced by Nihon Yushi Co., Ltd. Especially preferable are C-(49), C-(50), C-(52), C-(53) and c-(55).

The content of the saccharide in the solid developing composition of the invention is 0.5 to 30% by weight, and preferably 1.0 to 20% by weight.

The compound represented by Formula (II) will be explained below.

In Formula (II), $R_1$ represents a hydrogen atom or a straight-chained or branched alkyl group having 1 to 40, preferably 3 to 30 carbon atoms which may have a substituent and $R_2$ represents a hydrogen atom or a straight-chained or branched alkyl group having 1 to 10 carbon atoms which may have a substituent, and among them, a hydrogen atom, a methyl group, an ethyl group, a propyl group, a butyl group or an amyl group is preferred and a methyl group is especially preferred. $R_3$ represents a straight-chained or branched alkylene group having 1 to 10 carbon atoms which may have a substituent. The substituent includes a carboxymethyl group, a carboxyethyl group, a carboxypropyl group, a carboxybutyl group or a carboxyamyl group. The preferable examples of $R_3$ include a methylene group, an ethylene group, a butylene group, a propylene group, a carboxymethylmethylene group, a carboxyethylmethylene group, a carboxymethylethylene group or a carboxyethylethylene group, and the especially preferable is an ethylene group.

M represents a hydrogen atom, an sodium atom, a potassium atom, a lithium atom or a triethanol ammonium group.

Among compounds represented by Formula (II), compounds represented by the following Formula (III) are preferable.

$$R_4-CO-\overset{\overset{\displaystyle CH_3}{|}}{N}-CH_2CH_2COOM_1 \qquad \text{Formula (III)}$$

In Formula (III), $R_4$ represents a straight-chained or branched alkyl group having 1 to 40 carbon atoms which may have a substituent and preferably represents an alkyl group having 3 to 30 carbon atoms. $M_1$ represents a hydrogen atom, an sodium atom, a potassium atom, a lithium atom or a triethanol ammonium group.

Among the compounds represented by Formula (II), some typical examples thereof will be given below. However, the invention shall not be limited to the compounds given below.

$$C_5H_{11}-\overset{\overset{\displaystyle CH_3}{|}}{CON}-CH_2CH_2COONa \qquad \text{2-1}$$

$$C_5H_{11}-\overset{\overset{\displaystyle CH_3}{|}}{CON}-CH_2CH_2COOK \qquad \text{2-2}$$

$$C_5H_{11}-\overset{\overset{\displaystyle CH_3}{|}}{CON}-CH_2CH_2COOH \qquad \text{2-3}$$

$$C_7H_{15}-\overset{\overset{\displaystyle CH_3}{|}}{CON}-CH_2CH_2COONa \qquad \text{2-4}$$

$$C_7H_{15}-\overset{\overset{\displaystyle CH_3}{|}}{CON}-CH_2CH_2COOK \qquad \text{2-5}$$

$$C_7H_{15}-\overset{\overset{\displaystyle CH_3}{|}}{CON}-CH_2CH_2COOH \qquad \text{2-6}$$

$$C_9H_{19}-\overset{\overset{\displaystyle CH_3}{|}}{CON}-CH_2CH_2COONa \qquad \text{2-7}$$

$$C_9H_{19}-\overset{\overset{\displaystyle CH_3}{|}}{CON}-CH_2CH_2COOK \qquad \text{2-8}$$

$$C_9H_{19}-\overset{\overset{\displaystyle CH_3}{|}}{CON}-CH_2CH_2COOH \qquad \text{2-9}$$

$$C_{11}H_{23}-\overset{\overset{\displaystyle CH_3}{|}}{CON}-CH_2CH_2COONa \qquad \text{2-10}$$

-continued 2-11

$$C_{11}H_{23}-\overset{\overset{\displaystyle CH_3}{|}}{CON}-CH_2CH_2COOK$$

2-12

$$C_{11}H_{23}-\overset{\overset{\displaystyle CH_3}{|}}{CON}-CH_2CH_2COOH$$

2-13

$$C_{13}H_{27}-\overset{\overset{\displaystyle CH_3}{|}}{CON}-CH_2CH_2COONa$$

2-14

$$C_{13}H_{27}-\overset{\overset{\displaystyle CH_3}{|}}{CON}-CH_2CH_2COOK$$

2-15

$$C_{13}H_{27}-\overset{\overset{\displaystyle CH_3}{|}}{CON}-CH_2CH_2COOH$$

2-16

$$C_{15}H_{31}-\overset{\overset{\displaystyle CH_3}{|}}{CON}-CH_2CH_2COONa$$

2-17

$$C_{15}H_{31}-\overset{\overset{\displaystyle CH_3}{|}}{CON}-CH_2CH_2COOK$$

2-18

$$C_{15}H_{31}-\overset{\overset{\displaystyle CH_3}{|}}{CON}-CH_2CH_2COOH$$

2-19

$$C_{17}H_{35}-\overset{\overset{\displaystyle CH_3}{|}}{CON}-CH_2CH_2COONa$$

2-20

$$C_{17}H_{35}-\overset{\overset{\displaystyle CH_3}{|}}{CON}-CH_2CH_2COOK$$

2-21

$$C_{17}H_{35}-\overset{\overset{\displaystyle CH_3}{|}}{CON}-CH_2CH_2COOH$$

2-22

$$C_{19}H_{39}-\overset{\overset{\displaystyle CH_3}{|}}{CON}-CH_2CH_2COONa$$

2-23

$$C_{19}H_{39}-\overset{\overset{\displaystyle CH_3}{|}}{CON}-CH_2CH_2COOK$$

2-23

$$C_{19}H_{39}-\overset{\overset{\displaystyle CH_3}{|}}{CON}-CH_2CH_2COOH$$

2-25

$$CH_3(CH_2)_{12}CH{=}CH-\overset{\overset{\displaystyle CH_3}{|}}{CON}-CH_2CH_2COONa$$

2-26

$$CH_3(CH_2)_{12}CH{=}CH-\overset{\overset{\displaystyle CH_3}{|}}{CON}-CH_2CH_2COOK$$

2-27

$$CH_3(CH_2)_{12}CH{=}CH-\overset{\overset{\displaystyle CH_3}{|}}{CON}-CH_2CH_2COOH$$

2-28

$$CH_3(CH_2)_7CH{=}CH(CH_2)_7-\overset{\overset{\displaystyle CH_3}{|}}{CON}-CH_2CH_2COONa$$

2-29

$$CH_3(CH_2)_7CH{=}CH(CH_2)_7-\overset{\overset{\displaystyle CH_3}{|}}{CON}-CH_2CH_2COOK$$

2-30

$$CH_3(CH_2)_7CH{=}CH(CH_2)_7-\overset{\overset{\displaystyle CH_3}{|}}{CON}-CH_2CH_2COOH$$

2-31

$$CH_3(CH_2)_4CH{=}CHCH_2-CH{=}CH(CH_2)_7-\overset{\overset{\displaystyle CH_3}{|}}{CON}-CH_2CH_2COONa$$

-continued 2-32

$$CH_3(CH_2)_9CH{=}CHCH_2-CH{=}CH(CH_2)_7-\overset{\overset{\displaystyle CH_3}{|}}{CON}-CH_2CH_2COOK$$

2-33

$$CH_3(CH_2)_9CH{=}CHCH_2-CH{=}CH(CH_2)_7-\overset{\overset{\displaystyle CH_3}{|}}{CON}-CH_2CH_2COOH$$

2-34

$$C_5H_{11}-\overset{\overset{\displaystyle CH_3}{|}}{CON}-CH_2COONa$$

2-35

$$C_5H_{11}-\overset{\overset{\displaystyle CH_3}{|}}{CON}-CH_2COOK$$

2-36

$$C_5H_{11}-\overset{\overset{\displaystyle CH_3}{|}}{CON}-CH_2COOH$$

2-37

$$C_7H_{15}-\overset{\overset{\displaystyle CH_3}{|}}{CON}-CH_2COONa$$

2-38

$$C_7H_{15}-\overset{\overset{\displaystyle CH_3}{|}}{CON}-CH_2COOK$$

2-39

$$C_7H_{15}-\overset{\overset{\displaystyle CH_3}{|}}{CON}-CH_2COOH$$

2-40

$$C_9H_{19}-\overset{\overset{\displaystyle CH_3}{|}}{CON}-CH_2COONa$$

2-41

$$C_9H_{19}-\overset{\overset{\displaystyle CH_3}{|}}{CON}-CH_2COOK$$

2-42

$$C_9H_{19}-\overset{\overset{\displaystyle CH_3}{|}}{CON}-CH_2CH_2COOH$$

2-43

$$C_{11}H_{23}-\overset{\overset{\displaystyle CH_3}{|}}{CON}-CH_2CH_2COONa$$

2-44

$$C_{11}H_{23}-\overset{\overset{\displaystyle CH_3}{|}}{CON}-CH_2CH_2COOK$$

2-45

$$C_{11}H_{23}-\overset{\overset{\displaystyle CH_3}{|}}{CON}-CH_2COOH$$

2-46

$$C_{13}H_{27}-\overset{\overset{\displaystyle CH_3}{|}}{CON}-CH_2COONa$$

2-47

$$C_{13}H_{27}-\overset{\overset{\displaystyle CH_3}{|}}{CON}-CH_2COOK$$

2-48

$$C_{13}H_{27}-\overset{\overset{\displaystyle CH_3}{|}}{CON}-CH_2COOH$$

2-49

$$C_{15}H_{31}-\overset{\overset{\displaystyle CH_3}{|}}{CON}-CH_2COONa$$

+R2

2-50

$$C_{15}H_{31}-\overset{\overset{\displaystyle CH_3}{|}}{CON}-CH_2COOK$$

2-51

$$C_{15}H_{31}-\overset{\overset{\displaystyle CH_3}{|}}{CON}-CH_2COOH$$

2-52

$$C_{17}H_{35}-\overset{\overset{\displaystyle CH_3}{|}}{CON}-CH_2COONa$$

-continued 2-53

$$C_{17}H_{35}-\overset{\overset{\displaystyle CH_3}{|}}{CON}-CH_2COOK$$

2-54

$$C_{17}H_{35}-\overset{\overset{\displaystyle CH_3}{|}}{CON}-CH_2COOH$$

2-55

$$C_{19}H_{35}-\overset{\overset{\displaystyle CH_3}{|}}{CON}-CH_2COONa$$

2-56

$$C_{19}H_{35}-\overset{\overset{\displaystyle CH_3}{|}}{CON}-CH_2COOK$$

2-57

$$C_{19}H_{35}-\overset{\overset{\displaystyle CH_3}{|}}{CON}-CH_2COOH$$

2-58

$$CH_3(CH_2)_{12}CH{=}CH-\overset{\overset{\displaystyle CH_3}{|}}{CON}-CH_2COONa$$

2-59

$$CH_3(CH_2)_{12}CH{=}CH-\overset{\overset{\displaystyle CH_3}{|}}{CON}-CH_2COOK$$

2-60

$$CH_3(CH_2)_{12}CH{=}CH-\overset{\overset{\displaystyle CH_3}{|}}{CON}-CH_2COOH$$

2-61

$$CH_3(CH_2)_7CH{=}CH(CH_2)_7-\overset{\overset{\displaystyle CH_3}{|}}{CON}-CH_2COONa$$

2-62

$$CH_3(CH_2)_7CH{=}CH(CH_2)_7-\overset{\overset{\displaystyle CH_3}{|}}{CON}-CH_2COOK$$

2-63

$$CH_3(CH_2)_7CH{=}CH(CH_2)_7-\overset{\overset{\displaystyle CH_3}{|}}{CON}-CH_2COOH$$

2-64

$$CH_3(CH_2)_4CH{=}CHCH_2-CH{=}CH(CH_2)_7-\overset{\overset{\displaystyle CH_3}{|}}{CON}-CH_2COONa$$

2-65

$$CH_3(CH_2)_4CH{=}CHCH_2-CH{=}CH(CH_2)_7-\overset{\overset{\displaystyle CH_3}{|}}{CON}-CH_2COOK$$

2-66

$$CH_3(CH_2)_4CH{=}CHCH_2-CH{=}CH(CH_2)_7-\overset{\overset{\displaystyle CH_3}{|}}{CON}-CH_2COOH$$

2-67

$$C_5H_{11}-CONH-\underset{\underset{\displaystyle CH_2CH_2COONa}{|}}{CHCOONa}$$

2-68

$$C_5H_{11}-CONH-\underset{\underset{\displaystyle CH_2CH_2COOK}{|}}{CHCOOK}$$

2-69

$$C_5H_{11}-CONH-\underset{\underset{\displaystyle CH_2CH_2COOH}{|}}{CHCOOH}$$

2-70

$$C_7H_{15}-CONH-\underset{\underset{\displaystyle CH_2CH_2COONa}{|}}{CHCOONa}$$

2-71

$$C_7H_{15}-CONH-\underset{\underset{\displaystyle CH_2CH_2COOK}{|}}{CHCOOK}$$

2-72

$$C_7H_{15}-CONH-\underset{\underset{\displaystyle CH_2CH_2COOH}{|}}{CHCOOH}$$

2-73

$$C_9H_{19}-CONH-\underset{\underset{\displaystyle CH_2CH_2COONa}{|}}{CHCOONa}$$

-continued $C_9H_{19}-CONH-CH(CH_2CH_2COOK)COOK$ 2-74

$C_9H_{19}-CONH-CH(CH_2CH_2COOH)COOH$ 2-75

$C_{11}H_{23}-CONH-CH(CH_2CH_2COONa)COONa$ 2-76

$C_{11}H_{23}-CONH-CH(CH_2CH_2COOK)COOK$ 2-77

$C_{11}H_{23}-CONH-CH(CH_2CH_2COOH)COOH$ 2-78

$C_{13}H_{27}-CONH-CH(CH_2CH_2COONa)COONa$ 2-79

$C_{13}H_{27}-CONH-CH(CH_2CH_2COOK)COOK$ 2-80

$C_{13}H_{27}-CONH-CH(CH_2CH_2COOH)COOH$ 2-81

$C_{15}H_{31}-CONH-CH(CH_2CH_2COONa)COONa$ 2-82

$C_{15}H_{31}-CONH-CH(CH_2CH_2COOK)COOK$ 2-83

$C_{15}H_{31}-CONH-CH(CH_2CH_2COOH)COOH$ 2-84

$C_{17}H_{35}-CONH-CH(CH_2CH_2COONa)COONa$ 2-85

$C_{17}H_{35}-CONH-CH(CH_2CH_2COOK)COOK$ 2-86

$C_{17}H_{35}-CONH-CH(CH_2CH_2COOH)COOH$ 2-87

$C_{19}H_{39}-CONH-CH(CH_2CH_2COONa)COONa$ 2-88

$C_{19}H_{39}-CONH-CH(CH_2CH_2COOK)COOK$ 2-89

$C_{19}H_{39}-CONH-CH(CH_2CH_2COOH)COOH$ 2-90

$CH_3(CH_2)_{12}CH=CH-CONH-CH(CH_2CH_2COONa)COONa$ 2-91

$CH_3(CH_2)_{12}CH=CH-CONH-CH(CH_2CH_2COOK)COOK$ 2-92

$CH_3(CH_2)_{12}CH=CH-CONH-CH(CH_2CH_2COOH)COOH$ 2-93

$CH_3(CH_2)_7CH=CH(CH_2)_7-CONH-CH(CH_2CH_2COONa)COONa$ 2-94

-continued $CH_3(CH_2)_7CH{=}CH(CH_2)_7-CONH-CH(CH_2CH_2COOK)COOK$ 2-95

$CH_3(CH_2)_7CH{=}CH(CH_2)_7-CONH-CH(CH_2CH_2COOH)COOH$ 2-96

$CH_3(CH_2)_4CH{=}CHCH_2-CH{=}CH(CH_2)_7-CONH-CH(CH_2CH_2COONa)COONa$ 2-97

$CH_3(CH_2)_4CH{=}CHCH_2-CH{=}CH(CH_2)_7-CONH-CH(CH_2CH_2CHCOOK)COOK$ 2-98

$CH_3(CH_2)_4CH{=}CHCH_2-CH{=}CH(CH_2)_7-CONH-CH(CH_2CH_2COOH)COOH$ 2-99

Of these exemplified compounds, the preferable are 2-4, 2-7, 2-10, 2-13, 2-16, 2-37, 2-40, 2-43, 2-46, 2-49, 2-70, 2-73, 2-76, 2-79, and 2-82, and the especially preferable are 2-4, 2-7, 2-10, 2-13, and 2-16.

The content of the compound represented by Formula (II) in the solid developing composition is preferably 0.05 to 10% by weight, and more preferably 0.1 to 5% by weight.

The p-phenylenediamine compounds used in the invention preferably have a water solubilizing group.

The above-described p-phenylenediamine compounds have at least one water solubilizing group on their amino group or benzene ring. The examples of the hydrophilic group include $-(CH_2)_n-CH_2OH$, $-(CH_2)_m-NHSO_2-(CH_2)_n-CH_3$, $-(CH_2)_m-O-(CH_2)_nCH_3$, $-(CH_2CH_2O)_nC_mH_{2m+1}$ (m and n independently represent an integer of not less than 0), —COOH and $-SO_3H$.

Exemplified compounds of the p-phenylenediamine compounds preferably used in the present invention will be given below.

Exemplified compounds

X-(1)

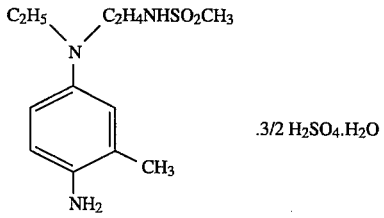

.3/2 $H_2SO_4.H_2O$

X-(2)

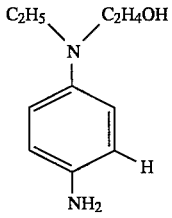

.$H_2SO_4$

X-(3)

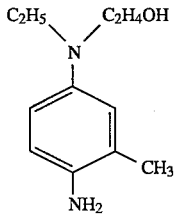

.$H_2SO_4$

-continued

X-(4)

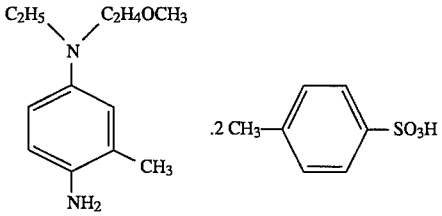

X-(5)

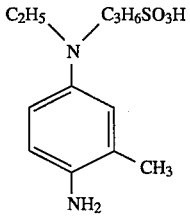

.$H_2SO_4$

X-(6)

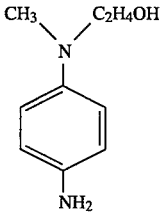

.1/2 $H_2SO_4$

X-(7)

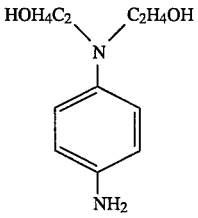

.$H_2SO_4$

X-(8)

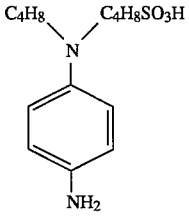

.1/2 $H_2SO_4$

-continued

X-(9)

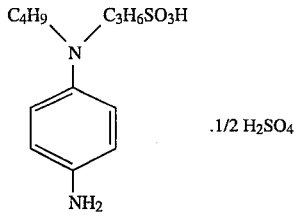

X-(10)

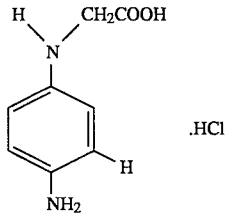

X-(11)

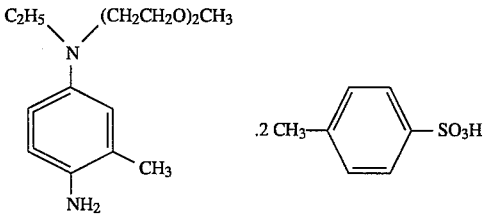

X-(12)

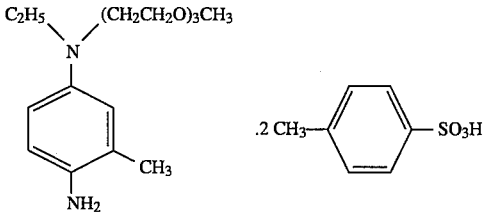

X-(13)

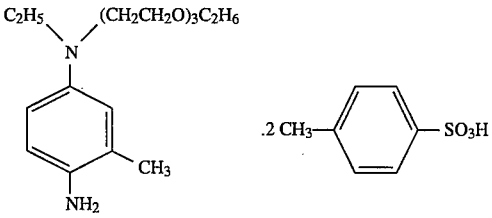

X-(14)

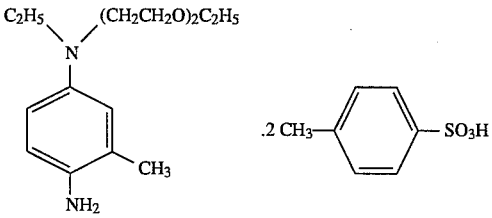

X-(15)

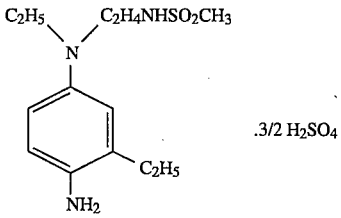

-continued

X-(16)

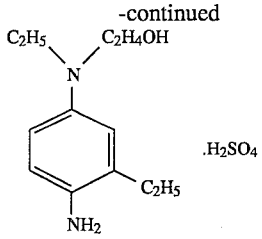

X-(17)

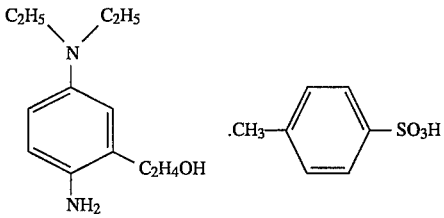

X-(18)

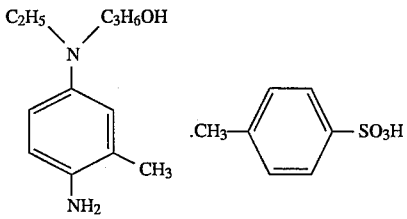

X-(19)

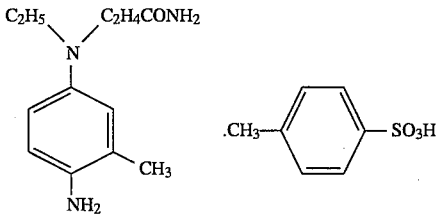

Of the above exemplified p-phenylenediamine compounds Exemplified compounds (1), (3) and (18) are especially preferable.

The content of the p-phenylenediamine compound in the solid developing composition is preferably 1 to 30% by weight, and more preferably 5 to 20% by weight.

The carbonates preferably used in the invention are potassium carbonate, sodium carbonate, potassium bicarbonate and sodium bicarbonate, and they are used singly or in combination.

In order to solidify the photographic processing composition, any method can be used in which concentrated solution or a mixture of fine-powdered or granuled processing agents with a water soluble binder is kneaded and molded or pre-molded processing agent is coated with a covered layer by spraying a water soluble binder. (See JP O.P.I. Publication Nos. 4-29136/1992, 4-85535/1992, 4-85536/1992, 4-85533/1992, 4-85534/1992 and 4-172341/1992.)

The preferable method for preparing tablets is a method in which a powedered processing composition is granulated and the resulting granules are tableted to obtain tablets. The tablets prepared by the above have advantages that solubility and storage stability are improved and stable photographic properties are obtained as compared with those prepared by the metohd that the solid processing composition is only mixed and then tableted.

As for the granulating processes for forming tablets, it is possible to use any of the well-known processes such as the processes of a rolling granulation, an extrusion granulation, a compression granulation, a cracking granulation, a stirring granulation, a fluidized-layer granulation and a spray-dry granulation. When the granules are mixed and compressed to obtain tablets, the average particle size of the granules is to be within the range of preferably 100 to 800 μm and more preferably 200 to 700 μm in that localization of components or so-called segregation occurs with difficulty. As to particle size distribution, not less than 60% of the granules have a deviation of preferably ±200 to 250 μm. The granules are used as they are.

When the granules are compressed, the well known compressors such as a hydraulic press machine, a single tableting machine, a rotary tableting machine and a bricketing machine can be used. The resulting solid processing composition may be in any form, and preferably in cylindrical form in view of productivity, handling or loose powder occurred in use.

The weight of tablets is preferably 1 to 30 g per tablet.

It is preferable that each component, for example, an alkali agent, a reducing agent, a bleaching agent, or a preservative, is separately granulated. As a result, the above effects become more remarkable.

EXAMPLES

Example 1

Tablets were prepared by the following procedures:

Procedure (A)

Additive (I) in an amount shown in Table 1, 200 g of sodium p-toluenesulfonate, 30 g of Tinopar SFP, 30 g of sodium diethylenetriaminepentaacetate and Additive (II) in an amount shown in Table 1 were mixed in a mixer available on the market and granulated while slowly adding water thereto. The added amount of water was 25 ml. Thereafter, the resulting granules were dried in a drier at 60° C. for 6 hours to have a moisture content of not more than 1% by weight. Finally, the granules were screened with a 16 mesh sieve.

Procedure (B)

CD-3, p-phenylenediamine compound of 150 g and 100 g of polyethyleneglycol (average molecular weight: 4000) were mixed in a mixer available on the market and granulated while slowly adding water thereto. The added amount of water was 20 ml. Thereafter, the resulting granules were dried in a drier at 40° C. for 12 hours to have a moisture content of not more than 1% by weight. Finally, the granules were screened with a 16 mesh sieve.

Procedure (C)

Sodium p-toluenesulfonate of 100 g, 4.0 g of sodium sulfite, 30 g of potassium hydroxided, 100 g of polyethyleneglycol (average molecular weight: 4000) and 330 g of potassium carbonate were mixed in a mixer available on the market and granulated while slowly adding water thereto. The added amount of water was 33 ml. Thereafter, the resulting granules were dried in a drier at 40° C. for 12 hours to have a moisture content of not more than 1% by weight. Finally, the granules were screened with a 16 mesh sieve.

The granules obtained by the above Procedures (A) through (C) and Additive (III) in an amount shown in Table 1 were mixed in a mixer for 10 minutes. The resulting mixture was tableted by means of a modified tableting machine of Tough-Press Correct 1527HU produced by Kikusui Mfg. Works. The tablets was molded in an amount of 11.0 g/tablet at a molding pressure of 990 kg/cm$^2$. The solid processing compositions were in a cylindrical form having a diameter of 30 mm. The following experiments were carried out for the above obtained solid compositions.

Experiment (1)

Each kind of tablet was stored under the following conditions, and thereafter, one of each kind of tablet was dissolved in 150 ml water and was evaluated for solubility.

| | Humidity | Temperature | Time |
|---|---|---|---|
| Condition 1 | 40% | 30° C. | for 2 days |
| Condition 2 | 60% | 30° C. | for 1 day |
| Condition 13 | 80% | 30° C. | for 10 hours |
| Evaluation criterions | | | |

A Completely soluble
B Slightly insoluble
C Insoluble, and oilish substances floating on the surface.

Experiment (2)

Each kind of tablet was packed in an aluminium container, closed tightly and stored under the following conditions. Thereafter, the tablet was removed and the diameter before and after the storage was measured.

Then, the expansion rate was calculated by the following equation:

$$\frac{(\text{a diameter after storage} - \text{a diameter before storage}) \times 100}{\text{a diameter before storage}} \quad (\%)$$

| | Humidity | Temperature | Time |
|---|---|---|---|
| Condition 4 | 50% | 30° C. | for 2 months |
| Condition 5 | 50% | 40° C. | for 2 months |
| Condition 6 | 50% | 50° C. | for 2 months |
| Experiment (3) | | | |

Ten sample tablets were randomly taken out of 100 tablets, and dissolved in 150 ml of water. The contents of p-phenylenediamine compound, $K_2CO_3$ and brightening agent Tinopar SFP (hereinafter referred to as FWD) in the resulting solution were measured and the fluctuation degree was represented by a standard deviation.

The results are shown in Table 1.

TABLE 1

| Sample | Additive (I) | | Additive (II) | | Additive (III) | | Solubility Conditions | | | Storage Stability (Diameter Expansion Rate, %) Conditions | | | Fluctuation (%) | | |
|---|---|---|---|---|---|---|---|---|---|---|---|---|---|---|---|
| No. | Kinds | (g) | Kinds | (g) | Kinds | (g) | 1 | 2 | 3 | 4 | 5 | 6 | CD-3 | $K_2CO_3$ | FWD |
| 1 (Comp.) | DEHA | 40 | — | — | — | — | B | C | C | 2.4% | 4.1% | 10.5% | ±21% | ±27% | ±44% |
| 2 (Comp.) | DEHA | 40 | B-76 | 30 | 2-13 | 10 | B | B | C | 2.5% | 4.2% | 9.7% | ±14% | ±14% | ±25% |
| 3 (Comp.) | (7) | 40 | — | — | — | — | A | B | B | 2.1% | 4.2% | 11.4% | ±10% | ±19% | ±37% |
| 4 (Inv.) | (7) | 40 | PVA | 30 | 2-13 | 10 | A | A | A | 2.2% | 2.7% | 5.5% | ±7% | ±8% | ±13% |
| 5 (Inv.) | (7) | 40 | B-76 | 30 | 2-13 | 10 | A | A | A | 1.8% | 2.0% | 4.0% | ±4% | ±3% | ±6% |
| 6 (Inv.) | (7) | 2 | B-76 | 30 | 2-13 | 10 | A | A | B | 2.2% | 2.5% | 5.6% | ±3% | ±4% | ±6% |
| 7 (Inv.) | (7) | 4 | B-76 | 30 | 2-13 | 10 | A | A | A | 2.1% | 2.4% | 4.9% | ±4% | ±4% | ±5% |
| 8 (Inv.) | (7) | 10 | B-76 | 30 | 2-13 | 10 | A | A | A | 2.0% | 2.4% | 4.7% | ±5% | ±5% | ±6% |
| 9 (Inv.) | (7) | 100 | B-76 | 30 | 2-13 | 10 | A | A | A | 1.9% | 2.4% | 4.3% | ±4% | ±4% | ±6% |
| 10 (Inv.) | (7) | 200 | B-76 | 30 | 2-13 | 10 | A | A | A | 1.9% | 2.5% | 4.4% | ±5% | ±5% | ±7% |
| 11 (Inv.) | (7) | 300 | B-76 | 30 | 2-13 | 10 | A | A | A | 2.0% | 2.5% | 4.7% | ±7% | ±7% | ±10% |
| 12 (Inv.) | (7) | 450 | B-76 | 30 | 2-13 | 10 | A | A | A | 1.9% | 2.6% | 5.2% | ±10% | ±9% | ±13% |
| 13 (Inv.) | (7) | 40 | B-76 | 30 | 2-13 | 0.5 | A | A | A | 2.1% | 2.7% | 5.3% | ±9% | ±10% | ±14% |
| 14 (Inv.) | (7) | 40 | B-76 | 30 | 2-13 | 1.0 | A | A | A | 2.2% | 2.3% | 4.9% | ±8% | ±8% | ±9% |
| 15 (Inv.) | (7) | 40 | B-76 | 30 | 2-13 | 2.0 | A | A | A | 2.0% | 2.1% | 4.4% | ±5% | ±6% | ±7% |
| 16 (Inv.) | (7) | 40 | B-76 | 30 | 2-13 | 20 | A | A | A | 2.1% | 2.1% | 4.3% | ±5% | ±5% | ±6% |
| 17 (Inv.) | (7) | 40 | B-76 | 30 | 2-13 | 50 | A | A | A | 2.2% | 2.3% | 4.3% | ±5% | ±5% | ±7% |
| 18 (Inv.) | (7) | 40 | B-76 | 30 | 2-13 | 80 | A | A | A | 2.0% | 2.4% | 4.5% | ±6% | ±5% | ±7% |
| 19 (Inv.) | (7) | 40 | B-76 | 30 | 2-13 | 150 | A | A | B | 2.3% | 2.5% | 5.1% | ±6% | ±6% | ±7% |
| 20 (Inv.) | (7) | 40 | B-76 | 30 | — | — | A | A | B | 2.3% | 2.5% | 5.3% | ±5% | ±6% | ±9% |
| 21 (Inv.) | (2) | 40 | B-76 | 30 | 2-13 | 10 | A | A | A | 2.1% | 2.3% | 4.7% | ±5% | ±6% | ±9% |
| 22 (Inv.) | (8) | 40 | B-76 | 30 | 2-13 | 10 | A | A | A | 1.9% | 2.3% | 4.6% | ±4% | ±5% | ±8% |
| 23 (Inv.) | (14) | 40 | B-76 | 30 | 2-13 | 10 | A | A | A | 2.1% | 2.4% | 4.7% | ±5% | ±6% | ±7% |
| 24 (Inv.) | (52) | 40 | B-76 | 30 | 2-13 | 10 | A | A | A | 2.3% | 2.4% | 4.8% | ±4% | ±5% | ±8% |
| 25 (Inv.) | (7) | 40 | B-69 | 30 | 2-13 | 10 | A | A | A | 2.2% | 2.5% | 4.9% | ±4% | ±4% | ±7% |
| 26 (Inv.) | (7) | 40 | B-74 | 30 | 2-13 | 10 | A | A | A | 2.2% | 2.6% | 5.0% | ±4% | ±5% | ±8% |
| 27 (Inv.) | (7) | 40 | Pine-flow | 30 | 2-13 | 10 | A | A | A | 2.3% | 2.5% | 5.2% | ±4% | ±5% | ±8% |
| 28 (Inv.) | (7) | 40 | B-76 | 30 | Boric acid | 10 | A | A | A | 2.3% | 2.7% | 6.0% | ±7% | ±8% | ±10% |
| 29 (Inv.) | (7) | 40 | B-76 | 30 | 2-7 | 10 | A | A | A | 2.2% | 2.7% | 5.0% | ±5% | ±5% | ±7% |
| 30 (Inv.) | (7) | 40 | B-76 | 30 | 2-10 | 10 | A | A | A | 2.3% | 2.6% | 4.8% | ±3% | ±4% | ±9% |
| 31 (Inv.) | (7) | 40 | B-76 | 30 | 2-16 | 10 | A | A | a | 2.3% | 2.7% | 4.9% | ±5% | ±5% | ±7% |

DEHA: diethylhydroxylamine, PVA: polyvinyl alcohol,
Pineflow: dextrin decomposition compound produced by Matsutani Kagaku Co., Ltd.

As is apparent from Table 1, the combination of the invention exhibits improved results excellent in solubility, storage stability (Expansion) and the component fluctuation. Further, a combination of compounds represented by Formula (II) and saccharides gives more preferable results.

Example 2

Procedure (E)

In a hammer-mill available on the market 1500 g of Additive (I), 6000 g of sodium p-toluenesulfonate, 1200 g of Tinopar SFP and 1200 g of Additive (II) were pulverized to have an average particle size of 10 μm. The resulting fine particles were granulated for 6 minutes in a stirring granulator available on the market, adding 300 ml of water thereto. Thereafter, the granules were dried at 60° C. in a fluid-bed type drier available on the market, and sieved with a 1.00 mm screen to obtain granule sample (E).

Procedure (F)

In a hammer-mill available on the market 8000 g of p-phenylenediamine compound X-(1) and 2000 g of Additive (III) were pulverized to have an average particle size of 10 μm. The resulting fine particles were granulated for 6 minutes in a stirring granulator available on the market, while adding 300 ml of water thereto. Thereafter, the granules were dried at 45° C. in a fluid-bed type drier available on the market, and sieved with a 1.00 mm screen to obtain granule sample (F).

Procedure (G)

In a hammer-mill available on the market 2800 g of sodium p-toluenesulfonate, 80 g of sodium sulfite, 800 g of lithium hydroxide monohydrate, 7000 g of potassium carbonate, 700 g of pentasodium diethylenetriamine pentaacetate, 2500 g of polyethylene glycol average molecular weight:4000) and 1000 g of Additive (III) were pulverized to have an average particle size of 10 μm. The resulting fine particles were granulated for 6 minutes in a stirring granulator available on the market, while adding 600 ml of water thereto. Thereafter, the granules were dried at 50° C. in a fluid-bed type drier available on the market, and sieved with a 1.00 mm screen to obtain granule sample (G).

Procedure (H)

Granule sample (E) of 4600 g, 3400 g of granule sample (F) and 12000 g of granule sample (G) were mixed in a cross-rotary mixer available on the market for 10 minutes to obtain granule sample (H).

Procedure (I)

To the granule sample (H) was added 100 g of Additive (IV) pulverized to not more than 100 μm and mixed in a cross-rotary mixer available on the market for 5 minutes to obtain granule sample (I).

Procedure (J)

The granule sample (I) was tableted at a molding pressure of 1400 kg/cm$^2$ using a modified rotary tableting machine available on the market. The obtained tablets were in the cyrindrical form having a weight of 10.6 g, a diameter of 30 mm and a thickness of about 10 mm.

Experiment (4)

The tablets prepared in Procedure (J) were processed and evaluated in the same manner as in Experiment (1).

Experiment (5)

The tablets prepared in Procedure (J) were processed and evaluated in the same manner as in Experiment (2).

Experiment (6)

The hardness of the tablets stored in Experiment (5) were measured by means of a modified pressure-rupture strength meter TS-50N produced by Okada Seiko Co., Ltd. The results are shown in Table 2.

TABLE 2

| Sample | Additive (I) | Additive (II) | Additive (III) | Additive (IV) | Solubility Conditions | | | Storage Stability (Diameter Expansion Rate variation, %) Conditions | | | Storage Stability (Hardness) Conditions | | |
|---|---|---|---|---|---|---|---|---|---|---|---|---|---|
| No. | Kinds | Kinds | Kinds | Kinds | 1 | 2 | 3 | 4 | 5 | 6 | 4 | 5 | 6 |
| 1 (Comp.) | DEHA | PEG6000 | PEG6000 | Boric acid | B | C | C | 2.6% | 4.7% | 11.4% | 55 kg | 41 kg | 24 kg |
| 2 (Comp.) | DEHA | B-76 | PEG6000 | Boric acid | B | B | C | 2.7% | 4.5% | 10.9% | 54 kg | 40 kg | 26 kg |
| 3 (Inv.) | (7) | PEG6000 | PEG6000 | 2-13 | A | A | A | 2.5% | 2.7% | 5.4% | 57 kg | 55 kg | 50 kg |
| 4 (Inv.) | (7) | B-76 | PEG6000 | Boric acid | A | A | A | 2.0% | 2.5% | 5.0% | 61 kg | 57 kg | 53 kg |
| 5 (Inv.) | (7) | B-76 | B-76 | 2-13 | A | A | A | 1.8% | 2.1% | 3.9% | 60 kg | 59 kg | 57 kg |
| 6 (Inv.) | (7) | B-76 | Pineflow | 2-13 | A | A | A | 2.1% | 2.4% | 5.1% | 59 kg | 55 kg | 50 kg |
| 7 (Inv.) | (7) | B-76 | B-76 | 2-10 | A | A | A | 2.2% | 2.6% | 5.2% | 58 kg | 54 kg | 51 kg |
| 8 (Inv.) | (7) | PEG6000 | B-76 | 2-13 | A | A | A | 2.3% | 2.6% | 4.9% | 57 kg | 53 kg | 52 kg |
| 9 (Inv.) | (7) | B-69 | B-76 | 2-13 | A | A | A | 2.4% | 2.7% | 4.8% | 59 kg | 55 kg | 53 kg |
| 10 (Inv.) | (7) | B-74 | B-76 | 2-13 | A | A | A | 2.4% | 2.6% | 4.9% | 58 kg | 51 kg | 50 kg |
| 11 (Inv.) | (2) | B-76 | B-76 | 2-13 | A | A | A | 2.5% | 2.8% | 5.3% | 57 kg | 53 kg | 49 kg |

As is apparent from Table 2, the combination of the invention exhibits improved results excellent in solubility, and storage stability at high temperature.

Example 3

To the granule sample (E) was added Additive (III) (purverized to a diameter of not more than 100 μm) in an amount of 0.5 weight % and mixed for 10 minutes in a cross-rotary mixer. Thereafter, the mixure was tableted at a molding pressure of 1400 kg/cm$^2$ using a modified rotary tableting machine available on the market. The obtained tablets were in a cylindrical form having a weight of 10.0 g, a diameter of 30 mm and a thickness of about 10 mm.

The tablets above prepared were processed and evaluated in the same manner as in Experiments (4) to (6) of Example 2.

The results are shown in Table 3.

TABLE 3

| Sample | Additive (I) | Additive (II) | Additive (III) | Solubility Conditions | | | Storage Stability (Diameter Expansion Rate Variation, %) Conditions | | | Storage Stability (Hardness) Conditions | | |
|---|---|---|---|---|---|---|---|---|---|---|---|---|
| No. | Kinds | Kinds | Kinds | 1 | 2 | 3 | 4 | 5 | 6 | 4 | 5 | 6 |
| 1 (Comp.) | DEHA | PEG6000 | Boric acid | C | C | C | 3.7% | 6.1% | 12.9% | 57 kg | 39 kg | 21 kg |
| 2 (Comp.) | DEHA | B-76 | 2-13 | B | C | C | 3.5% | 5.5% | 11.7% | 56 kg | 41 kg | 24 kg |
| 3 (Comp.) | (7) | PEG6000 | Boric acid | A | C | C | 3.9% | 4.9% | 12.4% | 59 kg | 43 kg | 25 kg |
| 4 (Inv.) | (7) | PEG6000 | 2-13 | A | A | A | 3.5% | 4.4% | 7.1% | 60 kg | 51 kg | 42 kg |
| 5 (Inv.) | (7) | B-76 | Boric acid | A | A | A | 3.2% | 4.0% | 6.7% | 57 kg | 49 kg | 42 kg |
| 6 (Inv.) | (7) | B-76 | 2-13 | A | A | A | 2.9% | 3.5% | 5.5% | 59 kg | 50 kg | 45 kg |
| 7 (Inv.) | (2) | B-76 | 2-13 | A | A | A | 3.1% | 3.9% | 6.7% | 57 kg | 50 kg | 44 kg |
| 8 (Inv.) | (7) | B-74 | 2-13 | A | A | A | 3.3% | 3.9% | 6.3% | 58 kg | 49 kg | 43 kg |
| 9 (Inv.) | (7) | Pineflow | 2-13 | A | A | A | 3.4% | 4.1% | 6.5% | 60 kg | 47 kg | 45 kg |
| 10 (Inv.) | (7) | B-76 | 2-10 | A | A | A | 3.3% | 4.2% | 6.6% | 57 kg | 50 kg | 44 kg |

As is apparent from Table 3, the combination of the invention exhibits improved results in solubility and storage stability.

Example 4

The following experiments were carried out for granule sample (H).

Experiment (7)

The granule sample of 50 g was packed in an aluminium container and tightly sealed. The sealed container was stored for 30 days in an atmosphere tester having a variation program from 0° C. to 60° C., and 60° C. to 0° C. After storage, the granule sample was taken out and vibration-classified for 30 minutes by a micro electromagnetic sieve (M-100 type). The amount of the granule sample remaining on the 1.5 mm mesh sieve was measured in terms of weight % and thereby the blocking degree of the granules was evaluated. Further, the granule sample was placed in a funnel having a mouth diameter of 75 mm, a tube diameter of 7 mm and a tube length of 80 mm made of hard glass and the sample was evaluated for fluidity.

The falling criterions are as follows:

5: The tube was completely clogged with granules and could not be dislodged by vibration.

4: The tube was often clogged and vigorous vibration was necessary for dislodging the granules.

3: The tube was often clogged but the granules completely dislodges with weak vibration.

2: The tube was clogged only once but the granules completely dislodges with weak vibration.

1: The granules flowed freely without clogging.

Experiment (8)

The granule sample (H) was evaluated in the same manner as in Experiment (1), except that 10.6 g of the granule sample was dissolved in 150 ml of water. The results are shown in Table 4.

TABLE 4

| Sample | Additive (I) | Additive (II) | Additive (III) | Storage Stability | | Solubility Conditions | | |
|---|---|---|---|---|---|---|---|---|
| No. | Kinds | Kinds | Kinds | Blocking | Falling | 1 | 2 | 3 |
| 1 (Comp.) | DEHA | PEG6000 | PEG6000 | 13.9% | 5 | A | B | C |
| 2 (Comp.) | DEHA | B-76 | PEG6000 | 10.7% | 4 | A | B | C |
| 3 (Comp.) | (7) | PEG6000 | PEG6000 | 12.5% | 5 | A | B | C |
| 4 (Inv.) | (7) | B-76 | PEG6000 | 2.4% | 1 | A | A | A |
| 5 (Inv.) | (7) | B-76 | B-76 | 2.1% | 1 | A | A | A |
| 6 (Inv.) | (7) | B-76 | Pineflow | 2.7% | 1 | A | A | A |
| 7 (Inv.) | (7) | PEG6000 | B-76 | 2.6% | 1 | A | A | A |
| 8 (Inv.) | (7) | B-69 | B-76 | 3.0% | 1 | A | A | A |
| 9 (Inv.) | (7) | B-74 | B-76 | 2.4% | 1 | A | A | A |
| 10 (Inv.) | (2) | B-76 | B-76 | 2.8% | 1 | A | A | A |

As is apparent from Table 4, the combination of the invention exhibits improved results excellent in solubility, and storage stability (blocking property and fluidity).

Example 5

The granule sample (E) was evaluated in the same manner as in Experiment (7). The results are shown in Table 5.

TABLE 5

| Sample | Additive (I) | Additive (II) | Storage Stability | |
|---|---|---|---|---|
| No. | Kinds | Kinds | Blocking | Falling |
| 1 (Comp.) | DEHA | PEG6000 | 11.8% | 5 |
| 2 (Comp.) | DEHA | B-76 | 10.9% | 4 |
| 3 (Comp.) | (7) | PEG6000 | 11.6% | 5 |

TABLE 5-continued

| Sample | Additive (I) | Additive (II) | Storage Stability | |
|---|---|---|---|---|
| No. | Kinds | Kinds | Blocking | Falling |
| 4 (Inv.) | (7) | B-76 | 3.0% | 1 |
| 5 (Inv.) | (2) | B-76 | 3.4% | 1 |
| 6 (Inv.) | (14) | B-76 | 3.6% | 1 |
| 7 (Inv.) | (52) | B-76 | 3.3% | 1 |
| 8 (Inv.) | (7) | B-69 | 4.0% | 1 |
| 9 (Inv.) | (7) | B-74 | 3.9% | 1 |
| 10 (Inv.) | (7) | Pineflow | 3.7% | 1 |

As is apparent from Table 5, the granules of the present invention exhibit improved results excellent in solubility, and storage stability (blocking property and fluidity).

Example 6

Procedure (K)

In a hammer-mill available on the market 9000 g of potassium carbonate, 1400 g of sodium sulfite, 600 g of pentasodium diethylenetriamine pentaacetate, 1200 g of polyethylene glycol average molecular weight:6000), 1900 g of sodium p-toluenesulfonate, 500 g of Additive (I) and 1000 g of Additive (II) were pulverized to have an average particle size of 10 μm. The resulting fine particles were granulated for 6 minutes in a stirring granulator available on the market, while adding 500 ml of water thereto. Thereafter, the granules were dried at 55° C. in a fluid-bed type drier available on the market, and sieved with a 1.00 mm screen to obtain granule sample (K).

Procedure (L)

In the same manner as in Procedure (K) 3200 g of hydroxylamine ½ sulfate, 400 g of potassium bromide, 180 g of pyrocatechol-3,5-disulfodisodium and 240 g of Additive (III) were pulverized and granulated while adding 120 ml of water thereto. Thereafter, the granules were dried at 55° C. to obtain granule sample (L).

Procedure (M)

In the same manner as in Procedure (K) 3500 g of p-phenylenediamine compound X-3, and 500 g of Additive (IV) were pulverized and granulated while adding 150 ml of water thereto. Thereafter, the granules were dried at 45° C. to obtain granule sample (M).

Procedure (N)

Granule sample (K) of 12000 g, 900 g of granule sample (L) and 1900 g of granule sample (M) were mixed in a cross-rotary mixer available on the market for 10 minutes to obtain granule sample (N).

Procedure (O)

To the granule sample (N) was added 75 g of Additive (V) pulverized to not more than 100 μm and mixed in a cross-rotary mixer available on the market for 5 minutes to obtain granule sample (O).

Procedure (P)

The granule sample (O) was tableted at a molding pressure of 1400 kg/cm$^2$ using a modified rotary tableting machine available on the market. The obtained tablets were in a cyrindrical form having a weight of 11.0 g, a diameter of 30 mm and a thickness of about 10 mm.

The following Experiments were carried out using the above obtained samples.

Experiment (9)

The Samples were evaluated in the same manner as in Experiments (1) through (3) and (6), except that the contents of the p-phenylenediamine compound, hydroxylamine ½ sulfate (HAS) and potassium bromide were measured in Experiment (3).

The results are shown in Table 6.

TABLE 6

| Sample | Additive (I) | Additive (II) | Additive (III) | Additive (IV) | Additive (V) | Solubility Conditions | | | Storage Stability (Diameter Expansion Rate Variation, %) Conditions | | | Storage Stability (Hardness) Conditions | | | Fluctuation (%) | | |
|---|---|---|---|---|---|---|---|---|---|---|---|---|---|---|---|---|---|
| No. | Kinds | Kinds | Kinds | Kinds | Kinds | 1 | 2 | 3 | 4 | 5 | 6 | 4 | 5 | 6 | X-3 | HAS | KBr |
| 1 (Comp.) | HAS | PEG6000 | PEG6000 | PEG6000 | Boric acid | A | C | C | 2.9% | 5.6% | 12.3% | 63.9 kg | 51.5 kg | 30.4 kg | ±14% | ±17% | ±13% |
| 2 (Comp.) | HAS | B-76 | B-76 | B-76 | 2-13 | A | A | B | 2.4% | 5.0% | 10.7% | 52.7 kg | 41.5 kg | 30.0 kg | ±12% | ±14% | ±11% |
| 3 (Comp.) | DEHA | B-76 | B-76 | B-76 | 2-13 | A | B | B | 2.5% | 4.7% | 11.3% | 53.4 kg | 43.0 kg | 31.1 kg | ±13% | ±13% | ±12% |
| 4 (Inv.) | (7) | PEG6000 | PEG6000 | PEG6000 | 2-13 | A | A | A | 2.4% | 3.4% | 6.0% | 64.0 kg | 50.9 kg | 42.3 kg | ±7% | ±7% | ±7% |
| 5 (Inv.) | (7) | B-76 | B-76 | B-76 | 2-13 | A | A | A | 1.8% | 2.3% | 4.1% | 54.4 kg | 47.0 kg | 44.5 kg | ±4% | ±4% | ±5% |
| 6 (Inv.) | (7) | B-76 | Pineflow | B-76 | 2-13 | A | A | A | 1.9% | 2.4% | 4.2% | 56.0 kg | 48.1 kg | 44.9 kg | ±5% | ±4% | ±4% |
| 7 (Inv.) | (7) | B-76 | PEG6000 | PEG6000 | Boric acid | A | A | A | 2.2% | 3.1% | 5.2% | 59.9 kg | 47.8 kg | 42.7 kg | ±6% | ±5% | ±6% |
| 8 (Inv.) | (7) | PEG6000 | B-76 | PEG6000 | Boric acid | A | A | A | 2.4% | 3.2% | 5.3% | 57.2 kg | 48.3 kg | 43.0 kg | ±6% | ±6% | ±6% |
| 9 (Inv.) | (7) | PEG6000 | PEG6000 | B-76 | Boric acid | A | A | A | 2.3% | 3.2% | 5.0% | 58.6 kg | 46.6 kg | 43.1 kg | ±7% | ±6% | ±5% |
| 10 (Inv.) | (7) | B-76 | B-76 | B-76 | Boric acid | A | A | A | 2.4% | 3.1% | 5.2% | 54.0 kg | 49.2 kg | 42.9 kg | ±5% | ±5% | ±6% |
| 11 (Inv.) | (2) | B-76 | B-76 | B-76 | 2-13 | A | A | A | 2.0% | 2.7% | 4.7% | 56.4 kg | 50.7 kg | 45.0 kg | ±6% | ±6% | ±7% |
| 12 (Inv.) | (7) | B-69 | B-76 | B-76 | 2-13 | A | A | A | 2.1% | 2.6% | 4.6% | 54.7 kg | 47.4 kg | 43.1 kg | ±6% | ±7% | ±6% |
| 13 (Inv.) | (7) | B-74 | B-76 | B-76 | 2-13 | A | A | A | 2.1% | 2.8% | 4.5% | 56.2 kg | 45.9 kg | 41.8 kg | ±5% | ±6% | ±7% |
| 14 (Inv.) | (7) | B-76 | B-76 | B-76 | 2-10 | A | A | A | 2.2% | 2.8% | 4.6% | 55.5 kg | 47.1 kg | 43.0 kg | ±5% | ±6% | ±6% |

As is apparent from Table 6, the combination of the invention exhibits improved results in solubility, storage stability (diameter expansion) and component fluctuation.

Example 7

Additive (III) (pulverized to not more than 100 μm) was added in an amount of 0.5 weight % to the granule sample (K) and mixed for 10 minutes in a cross-rotary mixer. Thereafter, the mixture was tableted at a molding pressure of 1400 kg/cm$^2$ using a modified rotary tableting machine available on the market. The obtained tablets were in a cyrindrical form having a weight of 11.5 g, a diameter of 30 mm and a thickness of about 10 mm.

The above obtained samples were evaluated in the same manner as in Experiments (1), (2) and (6).

The results are shown in Table 7.

TABLE 7

| Sample | Additive (I) | Additive (II) | Additive (III) | Solubility Conditions | | | Storage Stability (Diameter Expansion Rate Variation, %) Conditions | | | Storage Stability (Hardness) Conditions | | |
|---|---|---|---|---|---|---|---|---|---|---|---|---|
| No. | Kinds | Kinds | Kinds | 1 | 2 | 3 | 4 | 5 | 6 | 4 | 5 | 6 |
| 1 (Comp.) | HAS | B-76 | 2-13 | A | B | C | 2.7% | 4.1% | 7.2% | 53.9 kg | 46.1 kg | 30.6 kg |
| 2 (Comp.) | DEHA | B-76 | 2-13 | A | B | B | 2.5% | 4.2% | 7.0% | 52.5 kg | 42.7 kg | 29.4 kg |
| 3 (Comp.) | (7) | PEG6000 | Boric acid | A | A | C | 2.7% | 4.0% | 6.9% | 60.1 kg | 45.9 kg | 31.4 kg |
| 4 (Inv.) | (7) | PEG6000 | 2-13 | A | A | A | 2.7% | 3.0% | 4.1% | 60.4 kg | 53.4 kg | 45.6 kg |
| 5 (Inv.) | (7) | B-76 | Boric acid | A | A | A | 2.6% | 2.9% | 4.2% | 57.2 kg | 52.6 kg | 44.8 kg |
| 6 (Inv.) | (7) | B-76 | 2-13 | A | A | A | 2.3% | 2.6% | 3.5% | 56.9 kg | 53.6 kg | 46.9 kg |
| 7 (Inv.) | (2) | B-76 | 2-13 | A | A | A | 2.6% | 2.9% | 3.9% | 55.8 kg | 51.7 kg | 44.4 kg |
| 8 (Inv.) | (7) | B-74 | 2-13 | A | A | A | 2.8% | 3.1% | 3.7% | 54.7 kg | 52.0 kg | 43.7 kg |
| 9 (Inv.) | (7) | Pineflow | 2-13 | A | A | A | 2.7% | 3.0% | 3.8% | 56.5 kg | 51.1 kg | 42.9 kg |
| 10 (Inv.) | (7) | B-76 | 2-10 | A | A | A | 2.6% | 2.8% | 3.6% | 53.9 kg | 50.4 kg | 45.0 kg |

As is apparent from Table 7, the combination of the invention exhibits the effects of the invention.

Example 8

Granule sample (N) was evaluated in the same manner as in Example 4, except that 11 g of the sample was dissolved in 150 ml of water in solubility evaluation. The results are shown in Table 8.

TABLE 8

| Sample | Additive (I) | Additive (II) | Additive (III) | Additive (IV) | Storage Stability | | Solubility Conditions | | |
|---|---|---|---|---|---|---|---|---|---|
| No. | Kinds | Kinds | Kinds | Kinds | Blocking | Falling | 1 | 2 | 3 |
| 1 (Comp.) | HAS | B-76 | PEG6000 | PEG6000 | 11.5% | 5 | A | B | C |
| 2 (Comp.) | DEHA | B-76 | PEG6000 | PEG6000 | 9.3% | 4 | A | B | C |
| 3 (Comp.) | (7) | PEG6000 | PEG6000 | PEG6000 | 10.5% | 5 | A | B | C |
| 4 (Inv.) | (7) | B-76 | PEG6000 | PEG6000 | 4.5% | 2 | A | A | A |
| 5 (Inv.) | (7) | B-76 | B-76 | B-76 | 3.3% | 1 | A | A | A |
| 6 (Inv.) | (7) | B-76 | Pineflow | B-76 | 4.0% | 1 | A | A | A |
| 7 (Inv.) | (2) | B-76 | B-76 | B-76 | 4.2% | 1 | A | A | A |
| 8 (Inv.) | (7) | B-74 | B-76 | B-76 | 4.5% | 1 | A | A | A |
| 9 (Inv.) | (7) | PEG6000 | B-76 | PEG6000 | 4.6% | 2 | A | A | A |
| 10 (Inv.) | (7) | PEG6000 | PEG6000 | B-76 | 4.6% | 2 | A | A | A |

As is apparent from Table 8, the combination of the invention exhibits the effects of the invention.

Example 9

Granule sample (K) was evaluated in the same manner as in Experiment 7.

The results are shown in Table 9.

TABLE 9

| Sample | Additive (I) | Additive (II) | Storage Stability | |
|---|---|---|---|---|
| No. | Kinds | Kinds | Blocking | Falling |
| 1 (Comp.) | DEHA | PEG6000 | 9.9% | 5 |
| 2 (Comp.) | HAS | PEG6000 | 8.4% | 4 |
| 3 (Comp.) | (7) | PEG6000 | 8.6% | 5 |
| 4 (Inv.) | (7) | B-76 | 2.5% | 1 |
| 5 (Inv.) | (7) | Pineflow | 2.6% | 1 |

TABLE 9-continued

| Sample | Additive (I) | Additive (II) | Storage Stability | |
|---|---|---|---|---|
| No. | Kinds | Kinds | Blocking | Falling |
| 6 (Inv.) | (7) | B-74 | 3.0% | 1 |

TABLE 9-continued

| Sample No. | Additive (I) Kinds | Additive (II) Kinds | Storage Stability Blocking | Storage Stability Falling |
|---|---|---|---|---|
| 7 (Inv.) | (2) | B-76 | 3.1% | 1 |

As is apparent from Table 9, the combination of the invention exhibits the effects of the invention.

What is claimed is:

1. A solid color developing composition for developing color silver halide photographic light-sensitive materials, said composition comprising 0.3 to 25% by weight of a compound represented by Formula (I), and 0.05 to 10% by weight of a compound represented by Formula (II), or 0.5 to 30% by weight of a saccharide;

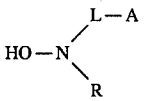

Formula (I)

wherein L represents alkylene; A represents carboxy, sulfo, phosphono, phosphinic acid, hydroxy, amino, ammonio, carbamoyl, or sulfamoyl; and R represents hydrogen or alkyl,

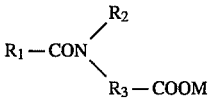

Formula (II)

wherein $R_1$ represents alkyl; $R_2$ represents hydrogen or alkyl; $R_3$ represents alkylene; and M represents hydrogen, sodium, potassium, lithium, or triethanolammonium.

2. The solid developing composition of claim 1, wherein in said Formula (I), L represents a methylene group, an ethylene group, a trimethylene group or a propylene group, each of which may have a carboxy group, a sulfo group, a phosphono group or a hydroxy group as a substituent; A represents a carboxy group, a sulfo group, a hydroxy group, a phosphono group and a carbamoyl group; and R represents a hydrogen atom, a carboxymethyl group, a carboxyethyl group, a sulfoethyl group, a sulfopropyl group, a phosphonomethyl group and a phosphonoethyl group.

3. The solid developing composition of claim 1, wherein said saccharide is a dextrin or a sugar alcohol.

4. The solid developing composition of claim 1, wherein said compound represented by said Formula (II) is a compound represented by the following Formula (III):

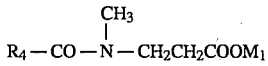

Formula (III)

wherein $R_4$ represents an alkyl group; and $M_1$ represents a hydrogen atom, an sodium atom, a potassium atom, a lithium atom or a triethanolammonium group.

5. The solid developing composition of claim 1, comprising said compound represented by Formula (I), said compound represented by Formula (II) and said saccharide.

6. The solid developing composition of claim 1, further comprising a p-phenylenediamine compound.

7. The solid developing composition of claim 6, wherein the content of said p-phenylenediamine compound is 1 to 30% by weight.

8. The solid developing composition of claim 6, wherein said p-phenylenediamine compound has a water-solubilizing group.

9. The solid developing composition of claim 8, wherein said water-solubilizing group includes $-(CH_2)_n-CH_2OH-$, $-(CH_2)_m-NHSO_2-(CH_2)_n-CH_3$, $-(CH_2)_m-O-(CH_2)_n-CH_3$, $-(CH_2CH_2O)_nC_mH_{2m+1}$, wherein m and n are each an integer of not less than 0, —COOH group and $-SO_3H$ group.

10. The solid developing composition of claim 1, wherein the composition is in a tablet form.

11. The solid developing composition of claim 9, wherein the weight of the tablet is 1 to 30 g/tablet.

* * * * *